US008497742B2

(12) United States Patent
Lee et al.

(10) Patent No.: US 8,497,742 B2
(45) Date of Patent: Jul. 30, 2013

(54) MULTI-LAYER WAVEGUIDE STRUCTURE HAVING SPACED APART FIRST AND SECOND SIGNAL UNITS OF DIFFERENT WIDTHS AND HEIGHTS

(75) Inventors: Dong-hyun Lee, Anyang-si (KR); Young-hwan Kim, Hwaseong-si (KR); Sung-tae Choi, Hwaseong-si (KR); Jung-han Choi, Hwaseong-si (KR); Cheol-gyu Hwang, Daejeon-si (KR); Young-woo Kwon, Seoul (KR); Woo-yeol Choi, Seoul (KR)

(73) Assignees: Samsung Electronics Co., Ltd., Suwon-si (KR); Seoul National University Industry Foundation, Seoul (KR)

( * ) Notice: Subject to any disclaimer, the term of this patent is extended or adjusted under 35 U.S.C. 154(b) by 435 days.

(21) Appl. No.: 12/682,103

(22) PCT Filed: Mar. 7, 2008

(86) PCT No.: PCT/KR2008/001303

§ 371 (c)(1),
(2), (4) Date: Jun. 4, 2010

(87) PCT Pub. No.: WO2009/048207

PCT Pub. Date: Apr. 16, 2009

(65) Prior Publication Data

US 2010/0244997 A1 Sep. 30, 2010

(30) Foreign Application Priority Data

Oct. 8, 2007 (KR) ..... 10-2007-0101118

(51) Int. Cl.
*H01P 3/08* (2006.01)

(52) U.S. Cl.
USPC ..... 333/1; 333/238

(58) Field of Classification Search
USPC ..... 333/1, 33, 109, 116, 238, 246
See application file for complete search history.

(56) References Cited

U.S. PATENT DOCUMENTS

| | | | | |
|---|---|---|---|---|
| 4,675,620 | A * | 6/1987 | Fullerton | 333/1 |
| 5,923,234 | A * | 7/1999 | Holzman et al. | 333/238 |
| 7,088,201 | B2 * | 8/2006 | Piernas | 333/116 |
| 2003/0222288 | A1 | 12/2003 | Schaper | |
| 2005/0140270 | A1 | 6/2005 | Henson et al. | |
| 2006/0115230 | A1 | 6/2006 | Komoguchi et al. | |
| 2007/0241844 | A1 | 10/2007 | Kim et al. | |

FOREIGN PATENT DOCUMENTS

| | | | |
|---|---|---|---|
| CN | 1745478 | A | 3/2006 |
| CN | 1914527 | A | 2/2007 |
| KR | 100731544 | B1 | 6/2007 |

OTHER PUBLICATIONS

Communication dated Aug. 17, 2012 issued by the State Intellectual Property Office of P.R. China in counterpart Chinese Patent Application No. 200880110594.4.
Communication, dated Apr. 15, 2013, issued by the State Intellectual Property Office of the People's Republic of China in counterpart Chinese Application No. 200880110594.4.

* cited by examiner

*Primary Examiner* — Benny Lee
(74) *Attorney, Agent, or Firm* — Sughrue Mion, PLLC

(57) ABSTRACT

A waveguide of a multi-layer metal structure and a manufacturing method thereof are provided, the method including applying a plurality of metal layers on a substrate and a plurality of insulating layers respectively between the respective metal layers. Accordingly, it is possible to minimize conductive loss by dispersing current uniformly through wide regions between a signal line and ground lines.

18 Claims, 3 Drawing Sheets

MULTI-LAYER WAVEGUIDE STRUCTURE HAVING SPACED APART FIRST AND SECOND SIGNAL UNITS OF DIFFERENT WIDTHS AND HEIGHTS

CROSS REFERENCE TO RELATED APPLICATIONS

This application is a National Stage application under 35 U.S.C. §371 of PCT/KR2008/001303 filed on Mar. 7, 2008, which claims priority from Korean Patent Application No. 10-2007-0101118, filed on Oct. 8, 2007 in the Korean Intellectual Property Office, all the disclosures of which are incorporated herein in their entireties by reference.

BACKGROUND

1. Field

Apparatuses and methods consistent with the exemplary embodiments relate to a waveguide of a multi-layer metal structure and a manufacturing method thereof, and more particularly, to a technology of designing a waveguide in a multi-layer metal structure where a plurality of metal layers are stacked on a substrate and a plurality of insulating layers are respectively formed between the respective metal layers.

2. Description of the Related Art

Studies are currently underway on various applications for a millimeter-wave band having frequencies higher than 60 GHz. Representative applications for the millimeter-wave band include a Local Multipoint Distribution Service (LMDS), a Wireless High Definition Multimedia Interface (HDMI), a Wireless Local Area Network (LAN), an Automotive Radar, and Satellite Communications.

An important factor in implementing a millimeter-wave circuit is the design of a waveguide. In a millimeter-wave band, unlike a low-frequency band, since the operating frequencies of circuits or active/passive elements may be equal to or higher than the millimeter-wave band, the waveguide of the circuits or active/passive elements should not have a lumped element characteristic. Rather, the waveguide of the circuits or active/passive elements should have a distributed element characteristic. Also, since the millimeter-wave band has a frequency dispersion characteristic, designing a waveguide is important for the operation and performance of a millimeter-wave circuit.

In order to transmit or process super high frequencies of a millimeter-wave band with low loss, a low-loss, high-performance waveguide is needed. Waveguide loss includes conductor loss of metals and dielectric loss of dielectrics.

Since the dielectric loss is reduced when the separation distance between a high-loss dielectric substrate and both signal lines and ground lines of a multi-layer metal structure is increased, the nearer the signal lines and ground lines are formed to an uppermost metal layer of the multi-layer metal structure, the less the dielectric loss of the signal lines and ground lines will be. Meanwhile, the lower the conductivity of metals used in the multi-layer metal structure and the more current that flows through a limited region, the greater the conductor loss.

Accordingly, the exemplary embodiments provide a waveguide structure which improves the quality and efficiency of transmission by widening a region through which current flows to minimize loss in a multi-layer metal structure.

SUMMARY OF THE INVENTION

The exemplary embodiments provide a waveguide of a multi-layer metal structure, in which a region through which current flows is widened to minimize a loss in the multi-layer metal structure, and a manufacturing method thereof.

Additional aspects will be set forth in the description which follows, and will be apparent to a certain extent from the description, or may be learned through experience with the exemplary embodiments.

According to an aspect of an exemplary embodiment, there is provided a waveguide of a multi-layer metal structure in which a plurality of metal layers are stacked on a substrate and a plurality of insulating layers are respectively formed between the plurality of metal layers, the waveguide including: at least one ground line; and a plurality of signal lines including a first signal unit formed on at least one of the plurality of metal layers and separated from the at least one ground line, and a second signal unit that has a wider width than that of the first signal unit, is separated from the at least one ground line, and is situated at a height which is different from that of the first signal unit.

It is to be understood that both the foregoing general description and the following detailed description are exemplary and explanatory and are intended to provide further explanation of the inventive concept as claimed.

BRIEF DESCRIPTION OF THE DRAWINGS

The accompanying drawings, which are included to provide a further understanding of the exemplary embodiments and are incorporated in and constitute a part of this specification, illustrate exemplary embodiments, and together with the description serve to explain aspects of the exemplary embodiments.

DETAILED DESCRIPTION OF EXEMPLARY EMBODIMENTS

Figure 1:
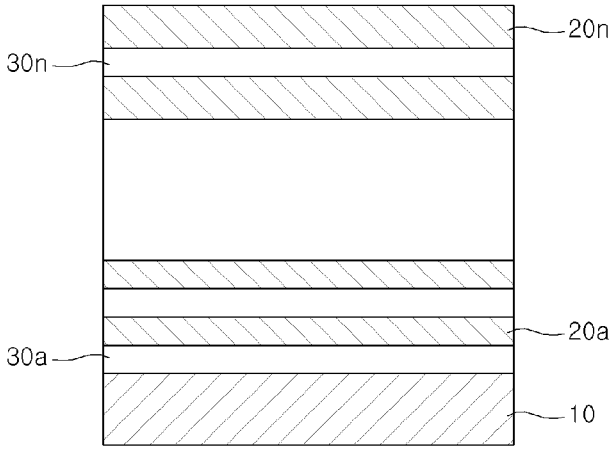
FIG. 1 shows an example of a multi-layer metal structure.

The exemplary embodiments are described more fully hereinafter with reference to the accompanying drawings, in which exemplary embodiments are shown. The inventive concept may, however, be embodied in many different forms and should not be construed as being limited to the exemplary embodiments set forth herein. Rather, these exemplary embodiments are provided so that this disclosure is thorough, and will fully convey the scope of the inventive concept to those skilled in the art. In the drawings, the size and relative sizes of layers and regions may be exaggerated for clarity. Like reference numerals in the drawings denote like elements.

FIG. 1 shows an example of a multi-layer metal structure. Referring to FIG. 1, the multi-layer metal structure has a structure where a plurality of metal layers 20*a* through 20*n*, made of materials such as copper (Cu) or aluminum (Al), are stacked on a dielectric substrate 10, made of a material such as silicon (Si), and a plurality of insulating layers 30*a* through 30*n*, made of a material such as silicon dioxide ($SiO_2$), are respectively formed between the metal layers 20*a* through 20*n*. The multi-layer metal structure may, for example, be manufactured using a process by which a Complementary Metal-Oxide Semiconductor (CMOS), a Metal Organic Chemical Vapor Deposition (MOCVD), a Low Temperature Co-fired Ceramic (LTCC), etc are manufactured.

Figure 2:
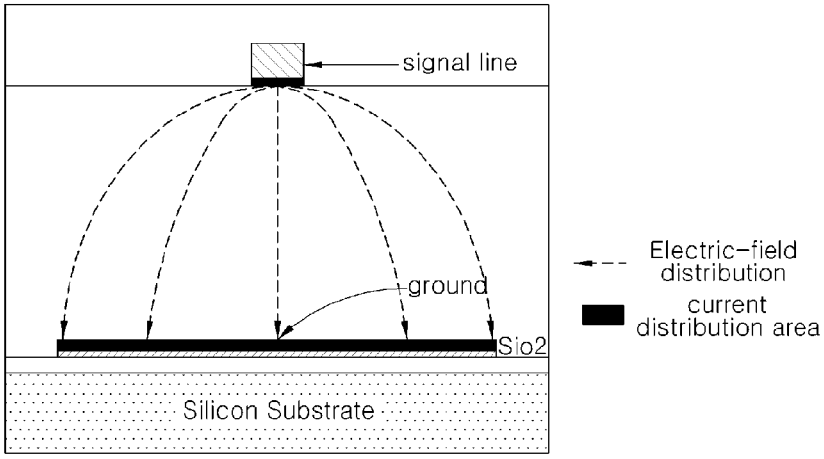
FIG. 2 shows an example of a thin-film microstrip line which is formed using a lowermost metal layer and an uppermost metal layer in a multi-layer metal structure.

FIGS. 2-6 illustrate an electric-field distribution (indicated by arrows) and a current distribution area (indicated by solid black lines). FIG. 2 shows an example of a thin-film microstrip line which is has a lowermost metal layer and an uppermost metal layer in a multi-layer metal structure separated from each other by an $SiO_2$ layer. As illustrated in FIG. 2, the lowermost metal layer of the multi-layer metal structure has a ground, and any one of signal lines (i.e., "signal line" in FIG.2) is formed on the uppermost metal layer of the multi-layer metal structure. Furthermore, in FIG. 2, the multi-layer metal structure may be stacked on a silicon substrate.

Figure 3:
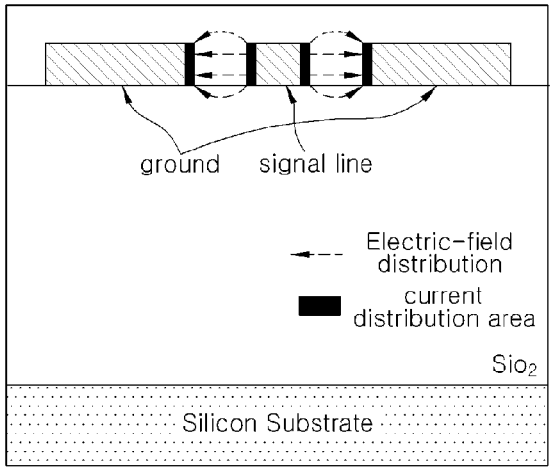
FIG. 3 shows an example of a co-planar waveguide where signal lines and ground lines are arranged on a co-planar metal layer.

FIG. 3 shows an example of a co-planar waveguide (CPW) where a signal line (i.e., "signal line" in FIG. 3) and ground lines (i.e., "ground" in FIG. 3) are arranged on a co-planar metal layer. As illustrated in FIG. 3, the co-planar waveguide has a structure where the signal line and the ground lines are on the uppermost metal layer of the multi-layer metal structure.

In the case of the co-planar waveguide illustrated in FIG. 3, it is possible to make the distances between the ground lines and signal line small in order to achieve low impedance. However, in this case, as illustrated in FIG. 3, charges accumulate at the adjacent surfaces of the ground lines and signal line and, thus, electrical fields form between the ground lines and signal line which are adjacent to each other so that a large amount of current flows through the narrow regions between the ground lines and signal line, which greatly increases the conductor loss.

Figure 4:
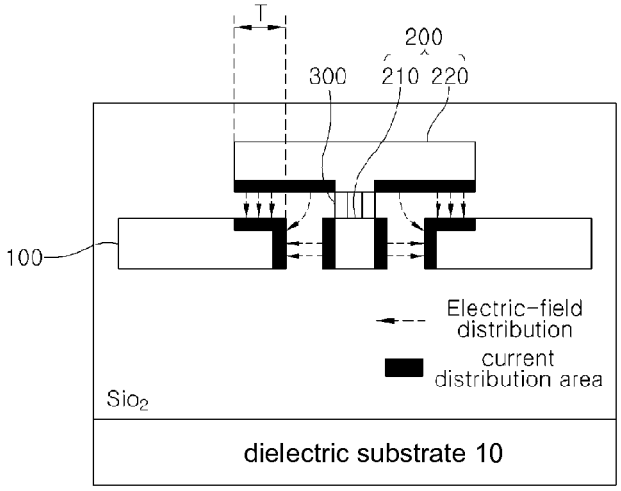
FIG. 4 is a cross-sectional view of a multi-layer metal structure including a waveguide according to an exemplary embodiment.

A waveguide which can disperse current uniformly through wide regions between signal lines 200 and ground lines 100 in order to reduce the conductor loss is illustrated in FIG. 4. A multi-layer metal structure having the waveguide illustrated in FIG. 4 is manufactured by stacking a plurality of metal layers on a dielectric substrate made of a material such as Si, and providing a plurality of insulating layers made of a material such as SiO2 between the respective metal layers.

The signal lines 200 include a first signal unit 210 and a second signal unit 220. The first signal unit 210 is on at least one of the metal layers, and separated from the ground lines 100. The second signal unit 220 has a wider width than that of the first signal unit 210, is separated from the ground lines 100, and is at a height which is different from the height of the first signal unit 210. An edge of the second signal unit 220 overlays a facing edge of a ground line, among the ground lines 100, by a distance T.

In this structure, if the dielectric substrate 10 is a high-loss dielectric substrate 10, the further the ground lines 100 and signal lines 200 are from the high-loss dielectric substrate 10, the less the dielectric loss will be. Thus, in an exemplary embodiment, the ground lines 100 and the signal lines 200 are as near as possible to an uppermost metal layer of the multi-layer metal structure.

Thus, in the waveguide of the multi-layer metal structure according to the present exemplary embodiment, charges are collected on the adjacent surfaces of the ground lines 100 and the first and second signal units 210 and 220 which are at different heights, and current flows through wide regions between the ground lines 100 and the first and second signal units 210 so that the conductive loss can be reduced. Accordingly, the transmission quality and efficiency of the multi-layer metal structure can be improved.

Meanwhile, the waveguide structure of the multi-layer metal structure may further include metal connectors 300. The metal connectors 300 are used to connect the first signal unit 210 to the second signal unit 220, and may be metal vias or metal bars. That is, charges collected on the surface of the first signal unit 210 diffuse to the second signal unit 220 via the metal connectors 300 and, thus, disperse on the surface of the second signal unit 220. Thus, the charges are dispersed and distributed widely on the adjacent surfaces of the ground lines 100 and the first and second signal units 210 and 220 which are at different heights, and current flows through wide regions between the ground lines 100 and the first and second signal units 210 and 220, thereby reducing the conductor loss.

Meanwhile, the waveguide of the multi-layer metal structure can be implemented in such a manner that both edges of the second signal unit 220 overlay the facing edges of the ground lines 100, as illustrated in FIG. 4.

In the case where both of the ends of the second signal unit 220 overlay the facing edges of the ground lines 100, the ground lines 100 face the first and second signal units 210 and 220 over regions wider than in the case where both edges of the second signal unit 220 do not overlay the facing edges of the ground lines 100. Accordingly, more charges are collected on the surface of the ground lines 100 and current flows through the wide regions between the ground lines 100 and the first and second signal units 210 and 220, thereby further reducing the conductor loss.

Meanwhile, in an exemplary embodiment, the ground lines 100 may be respectively at the left and right sides of the first signal unit 210. In the current exemplary embodiment, since the ground lines 100 are symmetrically placed about the first signal unit 210, the balance of current distribution can be achieved and the first and second signal units 210 and 220 can be stabilized.

Figure 5:
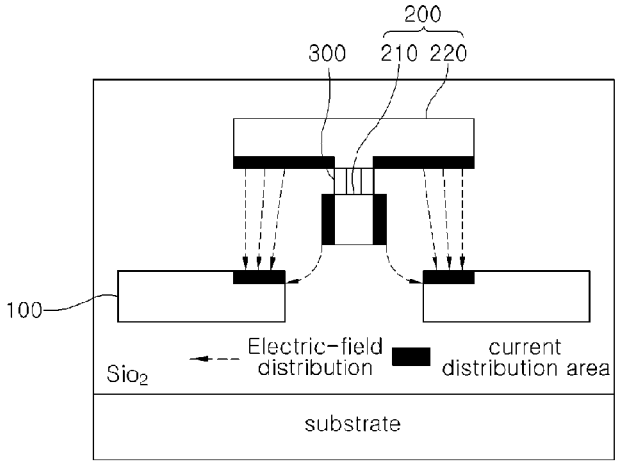
FIG. 5 is a cross-sectional view of a multi-layer metal structure including a waveguide according to another exemplary embodiment.

Meanwhile, the first signal unit 210 and the ground lines 100 of the multi-layer metal structure may be formed on a co-planar metal layer, as illustrated in FIG. 4, or may be formed on different metal layers, as illustrated in FIG. 5.

When the first signal unit 210 and the ground lines 100 are on different metal layers, the surfaces of the ground lines 100 on which charges are collected are smaller than in the case of the first signal unit 210 and the ground lines 100 being on the co-planar metal layer. Accordingly, the waveguide will have relatively high impedance.

Figure 6:
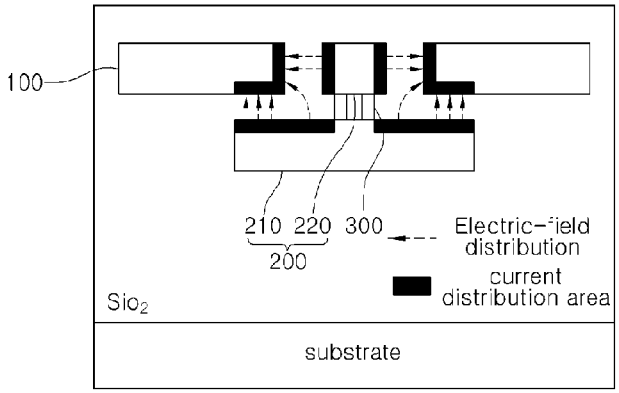
FIG. 6 is a cross-section view of a multi-layer metal structure including a waveguide according to another exemplary embodiment.

Meanwhile, the second signal unit 220 may be on an uppermost metal layer of the multi-layer metal structure and the first signal unit 210 may be on a metal layer below the uppermost metal layer, as illustrated in FIG. 4. In another exemplary embodiment, the first signal unit 210 may be on an uppermost metal layer of the multi-layer metal structure and the second signal unit 220 may be on a metal layer below the uppermost metal layer, as illustrated in FIG. 6.

However, there is no difference in the characteristics of the first and second signal units 210 and 220 if the process (see FIG. 4) of forming the first signal unit 210 and then forming the second signal unit 220 is used, relative to if the process (see FIG. 6) of forming the second signal unit 220 and then forming the first signal unit 210 is used.

A method of forming a waveguide in a multi-layer metal structure, according to an exemplary embodiment, will now be described with reference to FIG. 7. In order to form a waveguide in a multi-layer metal structure which is manufactured, for example, using a process by which a Complementary Metal-Oxide Semiconductor (CMOS), a Metal Organic Chemical Vapor Deposition (MOCVD), a Low Temperature Co-fired Ceramic (LTCC), etc., are manufactured, the following process is performed.

Figure 7:
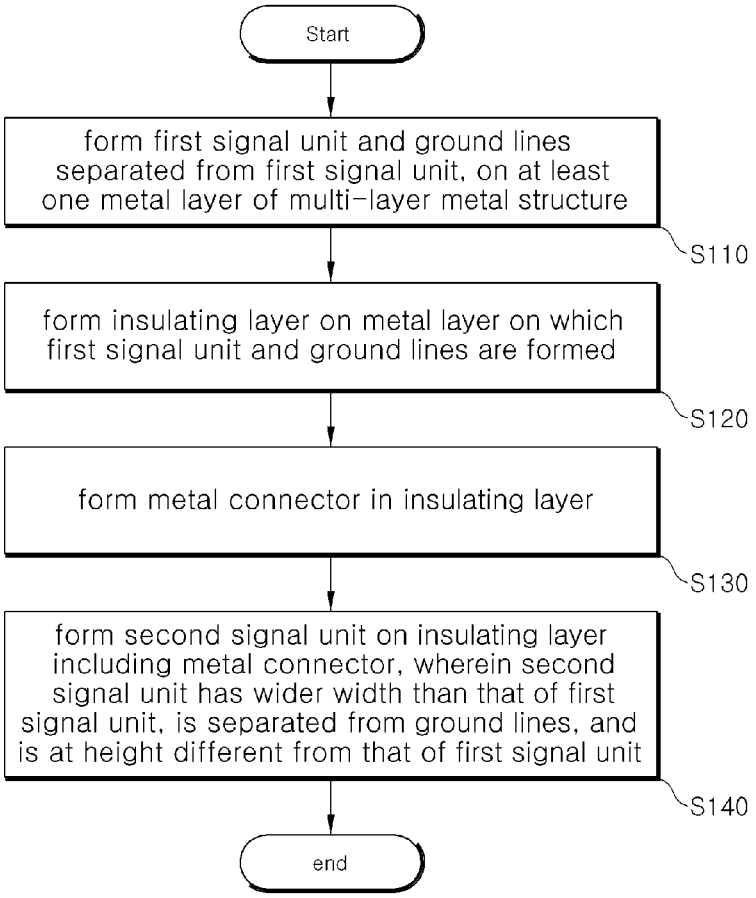
FIG. 7 is a flowchart of a method of forming a waveguide of a multi-layer metal structure according to an exemplary embodiment.

Referring to FIG. 7, in operation S110, a first signal unit 210 and ground lines 100 separated from the first signal unit 210 are formed on at least one metal layer of a multi-layer metal structure. The ground lines 100 may be respectively formed at opposite sides (e.g., left and right sides) of the first signal unit 210.

Forming the first signal unit 210 and ground lines 100 may be achieved by, for example, coating a photoresist on a metal layer on which the first signal unit 210 and the ground lines 100 will be formed, and then selectively exposing, developing, and etching, using a mask technique, only the portions of the metal layer on which the first signal unit 210 and the ground lines 100 are to be formed, to form holes. Then, metal layers may be deposited into the holes through an evaporation process using metal ions or a sputtering process, thereby forming the first signal unit 210 and the ground lines 100 on the metal layer of the multi-layer metal structure.

In operation S120, an insulating layer is formed on the metal layer on which the first signal unit 210 and the ground lines 100 are formed. The insulating layer may be formed by, for example, depositing an oxidation film made of a material such as SiO2 on the metal layer on which the first signal unit 210 and the ground lines 100 are formed.

In operation S130, metal connectors 300 are formed in the insulating layer. The metal connectors 300 may be metal vias or metal bars. Forming the metal connectors 300 may be achieved by, for example, coating a photoresist on the insulating layer, and selectively exposing, developing, and etching, using a mask technique, only the portions of the insulating layer on which the metal connectors 300 are to be formed in order to be connected to the first signal unit 210, to form holes.

Then, the metal connectors 300 can be formed by depositing metal layers into the holes through the evaporation process using metal ions or the sputtering process.

In operation S140, a second signal unit 220 is formed on the insulating layer in which the metal connectors 300 are formed in such a manner that the second signal unit 220 has a wider width than that of the first signal unit 210, is separated from the ground lines 100, and is at a height which is different from that of the first signal unit 210. The second signal unit 220 may be formed in such a manner that both edges of the second signal unit 220 overlay the facing edges of the ground lines 100. Finally, the flowchart concludes at End.

Forming the second signal unit 220 may be achieved by, for example, coating a photoresist on the insulating layer including the metal connectors 300, and then selectively exposing, developing, and etching, using a mask, only the portion of the metal layer in which the second signal unit 220 will be formed, to form a hole.

Then, the second signal unit 220 can be formed by depositing a metal layer into the hole through the evaporation process using metal ions or the sputtering process. Through the above-described processes, the waveguide of the multi-layer metal structure is formed.

It will be apparent to those skilled in the art that various modifications and variations can be made to the exemplary embodiments without departing from the spirit or scope of the exemplary embodiments. Thus, it is intended that the present inventive concept includes modifications and variations of the exemplary embodiments as described above provided they come within the scope of the appended claims and their equivalents.

The invention claimed is:

1. A waveguide of a multi-layer metal structure in which a plurality of metal layers are stacked on a substrate and a plurality of insulating layers are respectively formed between the plurality of metal layers, the waveguide comprising:

at least one ground line;

a plurality of signal lines including a first signal unit and a second signal unit formed on at least one of the plurality of metal layers and separated from the at least one ground line, and the second signal unit that has a width wider than a width of the first signal unit, is separated from the at least one ground line, and is situated at a height which is different from a height at which the first signal unit is situated, wherein an edge of the second signal unit overlays a facing edge of a ground line among the at least one ground line.

2. The waveguide of claim 1, further comprising at least one metal connector which connects the first signal unit to the second signal unit.

3. The waveguide of claim 1, wherein the at least one metal connector is a metal via or a metal bar.

4. The waveguide of claim 1, wherein the first signal unit is formed on an uppermost metal layer of the multi-layer metal structure, and the second signal unit is formed on a metal layer of the plurality of metal layers below the uppermost metal layer.

5. The waveguide of claim 1, wherein the at least one ground line comprises a first ground line at a left side of the first signal unit, and a second ground line at a right side of the first signal unit.

6. The waveguide of claim 1, wherein the first signal unit and the at least one ground line are on a co-planar metal layer of the plurality of metal layers.

7. The waveguide of claim 1, wherein the first signal unit and the at least one ground line are on different metal layers of the plurality of metal layers.

8. The waveguide of claim 1, wherein the second signal unit is on an uppermost metal layer of the multi-layer metal structure, and the first signal unit is on a metal layer of the plurality of metal layers below the uppermost metal layer.

9. A method for forming a waveguide in a multi-layer metal structure, the method comprising:

forming a first signal unit and at least one ground line separated from the first signal unit on at least one metal layer of the multi-layer metal structure;

forming a second signal unit at a height which is different from a height at which the first signal unit is situated, wherein the second signal unit has a width wider than a width of the first signal unit, is separated from the at least one ground line, wherein an edge of the second signal unit on at least one metal layer overlays a facing edge of a ground line among the at least one ground line.

10. The method of claim 9, wherein the forming the first signal unit and the at least one ground line comprises:

coating a photoresist on a metal layer of the multi-layer metal structure;

forming holes in the metal layer by selectively exposing, developing, and etching, using a mask technique, portions of the metal layer on which the first signal unit and the at least one ground line are to be formed; and forming the first signal unit and the at least one ground line on the metal layer by depositing metal layers into the holes through an evaporation process using metal ions or a sputtering process.

11. The method of claim 9, further comprising:

forming an insulating layer on the at least one metal layer on which the first signal unit and the at least one ground line are formed; and forming a metal connector in the insulating layer, wherein the second signal unit is formed on the insulating layer.

12. The method of claim 11, wherein the metal connector is a metal via or a metal bar.

13. The method of claim 11, wherein the forming the metal connector comprises:

coating a photoresist on the insulating layer;

forming holes in the insulating layer by selectively exposing, developing, and etching, using a mask technique, portions of the insulating layer on which the metal connector is to be formed; and forming the metal connector on the insulating layer by depositing metal layers into the holes through an evaporation process using metal ions or a sputtering process.

14. The method of claim 9, wherein the at least one ground line comprises a first ground line at a left side of the first signal unit, and a second ground line at a right side of the first signal unit.

15. A multi-layer metal structure comprising:

a substrate;

a plurality of metal layers stacked on the substrate;

a plurality of insulating layers respectively formed between the plurality of metal layers; and a waveguide comprising:

at least one ground line;

a plurality of signal lines including a first signal unit and a second signal unit formed on at least one of the plurality of metal layers and separated from the at least one ground line, and the second signal unit that has a wider width than a width of the first signal unit, is separated from the at least one ground line, and is situated at a height which is different from a height at which the first signal unit is situated, wherein an edge of the second signal unit overlays a facing edge of a ground line among the at least one ground line.

16. The multi-layer metal structure of claim 15, wherein the first signal unit is formed on an uppermost metal layer of the multi-layer metal structure, and the second signal unit is formed on a metal layer of the plurality of metal layers below the uppermost metal layer.

17. The multi-layer metal structure of claim 15, wherein the second signal unit is on an uppermost metal layer of the multi-layer metal structure, and the first signal unit is on a metal layer of the plurality of metal layers below the uppermost metal layer.

18. The multi-layer metal structure of claim 15, wherein the substrate is a dielectric substrate.

* * * * *